US006291080B1

(12) United States Patent
Yates et al.

(10) Patent No.: US 6,291,080 B1
(45) Date of Patent: Sep. 18, 2001

(54) THIN COPPER FOIL, AND PROCESS AND APPARATUS FOR THE MANUFACTURE THEREOF

(75) Inventors: Charles B. Yates, Princeton; George Gaskill, Manahawkin, both of NJ (US)

(73) Assignee: Yates Foll USA, Inc., Bordentown, NJ (US)

( * ) Notice: Subject to any disclaimer, the term of this patent is extended or adjusted under 35 U.S.C. 154(b) by 0 days.

(21) Appl. No.: 09/547,073

(22) Filed: Apr. 11, 2000

(51) Int. Cl.[7] ..... B21C 37/00

(52) U.S. Cl. ..... 428/606; 205/77; 205/97; 205/291; 204/206; 204/211; 204/212

(58) Field of Search ..... 205/77, 96, 97, 205/291; 204/206, 207, 211, 212, 216; 428/606

(56) References Cited

U.S. PATENT DOCUMENTS 5,326,455 * 7/1994 Kubo et al. ..... 205/77

* cited by examiner

*Primary Examiner*—Kathryn Gorgos
*Assistant Examiner*—Thomas H Parsons
(74) *Attorney, Agent, or Firm*—Finnegan, Henderson, Farabow, Garrett & Dunner, L.L.P.

(57) ABSTRACT

Copper foil produced on a rotating drum cathode machine, wherein each of the outer edge portions of a web of the foil has a thickness greater than the thickness of the central portion of the web. In the process and apparatus used to electrodeposit the foil on a drum cathode, electric current is passed through an electrolyte to the cathode from outboard edge anodes at a current density greater than the current density passed from a central anode to the cathode.

16 Claims, 4 Drawing Sheets

THIN COPPER FOIL, AND PROCESS AND APPARATUS FOR THE MANUFACTURE THEREOF

FIELD OF INVENTION

This invention relates to electrodeposited copper foil, particularly ultra-thin copper foil, and to a process and apparatus for producing such foil, wherein the outer edges of a web of copper foil as produced on a rotating drum cathode machine are thicker than the central portion of the web, so as to reduce the tendency for the foil to tear when it is stripped from the drum cathode.

BACKGROUND OF THE INVENTION

Copper foil for use in the manufacture of copper-clad laminates used in making printed circuit boards (PCB's) is usually made on a rotating drum cathode machine. In this method copper is electrodeposited on a rotating cylindrical drum cathode by passing an electric current from a lead, or lead-antimony, anode (usually two anodes) through a copper-containing electrolyte such as, an aqueous copper sulfate/sulfuric acid solution, to plate copper on the surface of a rotating drum cathode partially immersed in the electrolyte. The drum cathode typically has an outer top sheet formed of titanium or a similar metal. As the drum rotates, copper is plated onto the outer surface of the top sheet, and a web of raw copper foil is continuously stripped from the drum surface and coiled. Such stripping is possible because the top sheet of the drum is made of a metal such as titanium, which provides a low adhesion between the plated copper foil and the surface of the top sheet.

The thickness of the copper foil plated on the drum cathode is determined by a number of variable process parameters, and it is known to produce thin copper foil and ultra-thin copper foils, i.e., one-half ounce or less foils (those having a normal thickness of about 17 microns nominal thickness or less). However, the production efficiency of electrodeposited copper foil, especially ultra-thin copper foil, is reduced by a tendency for the raw foil to tear during the course of the processing. This problem is especially severe when very thin foil is being stripped from the drum cathode. This tearing problem makes the production of copper foil having a nominal thickness of 12 microns, or especially 9 micron foil, extremely difficult and uneconomical due to the extremely low production yields.

SUMMARY OF THE INVENTION

A primary object of the present invention is a copper foil, together with a process and apparatus for producing such foil, which overcomes the above-mentioned problems in prior art processes for producing copper foil.

Another object is a process, and apparatus, for producing ultra-thin copper foil, wherein tearing of the raw foil during processing is significantly reduced.

The above and other objects of the invention will become apparent from the following description of preferred embodiments of the invention and may be achieved by an elongated web of electrodeposited copper foil produced on a rotating cathode drum machine, comprising a central portion of the web extending longitudinally along the length of the web; and two edge portions of the web extending along the length of the web, one on either side of the central portion, wherein the central portion has a nominal thickness, and the edge portions each have a nominal thickness greater than that of the central portion.

The invention also provides an improved process for producing electrolytic copper foil wherein an electric current is passed from an anode through a copper-containing electrolyte to a rotating drum cathode spaced from the anode to electrodeposit copper foil on the cathode, which comprises passing an electric current from a central portion of the anode to an opposed central portion of the cathode, each of the central portions having a width less than the total width of the cathode, at a first current density; and simultaneously passing an electric current from the edge portions of the anode positioned outwardly of and adjacent the central portion of the anode to an opposed edge portion of the cathode at a second current density which is greater than the first current density to electrodeposit on the cathode a copper foil having edge portions thicker than the central portion thereof.

There is also provided a rotating drum cathode machine for producing copper foil comprising (a) a rotating drum cathode having a width extending in a direction parallel to an axis about which the drum rotates;

(b) at least one anode facing and spaced from the cathode, and having a width extending in a direction parallel to said cathode axis, the anode including a anode central portion having a width less than the width of the cathode, and two anode edge portions, each being positioned adjacent an outboard edge of one of the anode edge portions;

(c) the anode central portion being capable, during use of the machine, of passing an electric current from the anode central portion to the cathode at a first current density; and (d) the anode edge portions being capable, during use of the machine, of passing an electric current from each of the anode central portions to the cathode at a second current density which is greater than the first current density.

BRIEF DESCRIPTION OF THE DRAWINGS

The invention will be more fully understood by reference to the following description thereof in connection with the accompanying drawings, wherein like reference numbers designate like elements.

DESCRIPTION OF PREFERRED EMBODIMENTS OF THE INVENTION

Processes for the production of raw copper foil, using rotating drum cathode machines, for use in fabricating copper-clad laminates used in the electronics industry are well-known, and they need not be described herein in detail.

Figure 1:
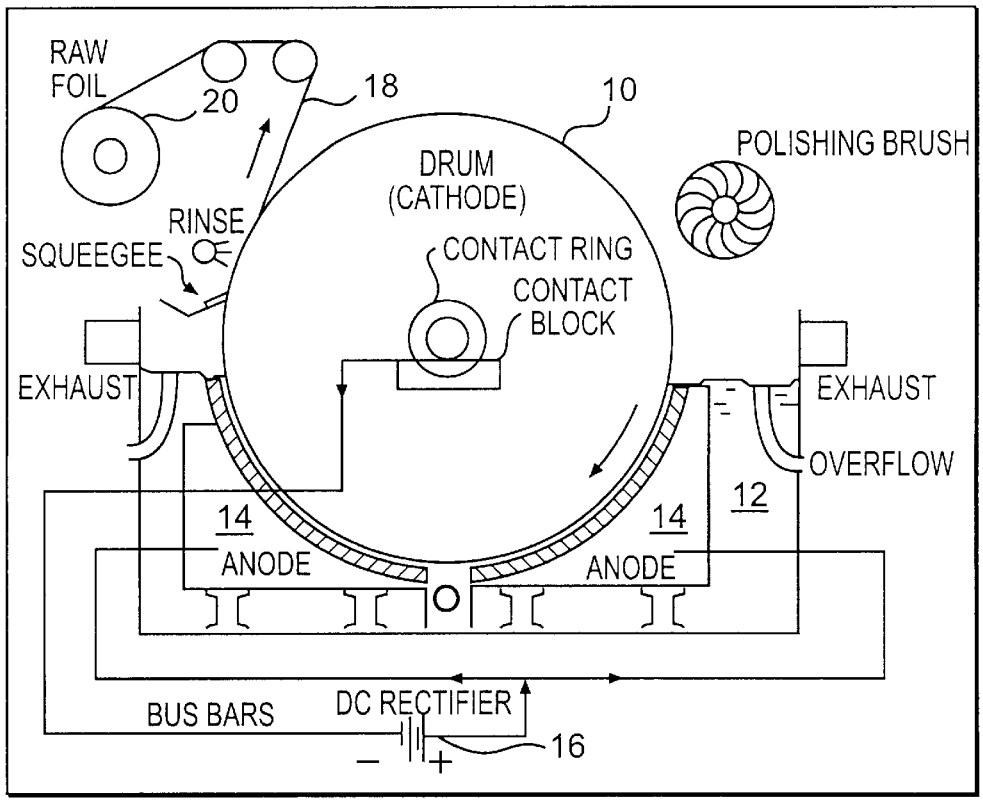
FIG. 1 illustrates an end view of a rotating drum cathode machine in accordance with the invention.

Referring to FIG. 1, the primary copper foil making operation typically involves using a large cylindrical drum cathode 10 that rotates partially immersed in a copper sulfate-sulfuric acid electrolyte 12.

Figure 4:
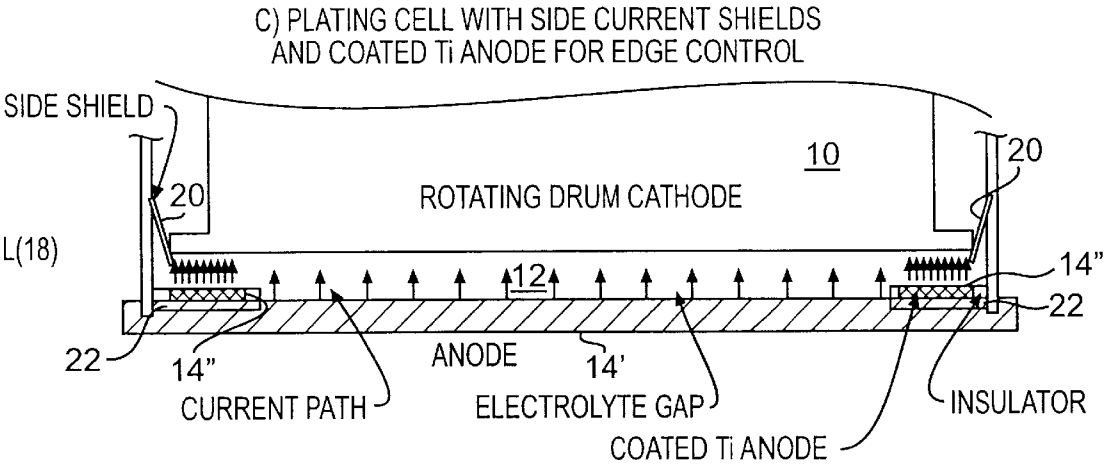
FIG. 4 illustrates a partial top view of a drum cathode and central and edge anode portions in accordance with a first embodiment of the invention.
Figure 5:
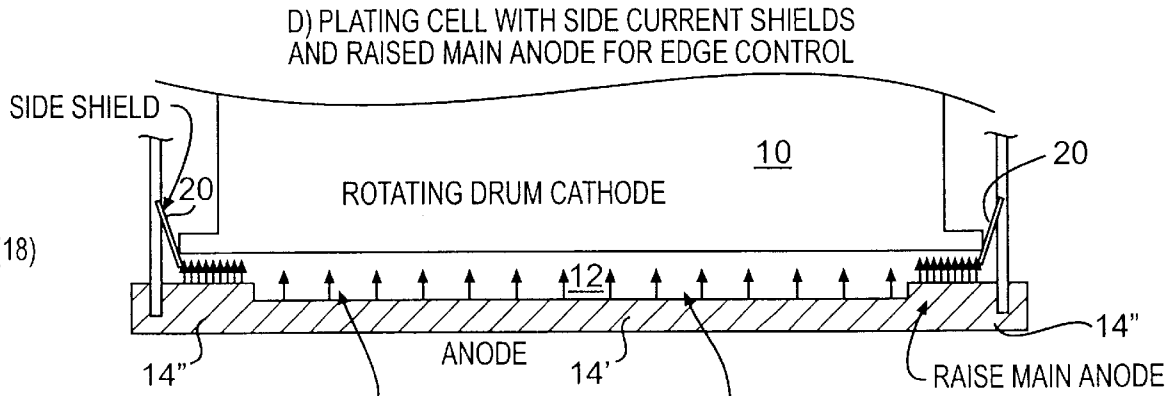
FIG. 5 illustrates a partial top view of a drum cathode and central and edge anode portions in accordance with a second embodiment of the invention.

Drum sizes vary among foil manufacturers. For example, drum diameters are usually 2.2, 2.7 or even 3 meters, while most drum widths are about 60 inches. Usually, the top surfaces of the drums are constructed of titanium or are chrome plated stainless steel. As shown in FIG. 1, the drum is spaced from and faces a pair of curved, heavy lead (lead-antimony) anodes 14. Insoluble anodes of platinized titanium or iridium or ruthenium oxides are also sometimes used, because they offer better performance. In accordance with the present invention, and, as shown in FIGS. 4 and 5, each anode 14 has a first, or central, anode portion 14' and two second, or edge, anode portions 14".

Both the drum and the anodes are electrically connected to a DC power source 16, each as a rectifier, via heavy buss-bars. Currents up to 70,000 amps or more are commonly used. As the drum rotates in the electrolyte, an electrodeposit of copper forms on the drum surface.

As the drum leaves the electrolyte, electrodeposited copper is continuously stripped from the rotating drum in the form of thin foil 18, which is trimmed and wrapped around take-up roll 20.

Foil produced in this manner is usually referred to as raw foil. It must possess physical, metallurgical and crystallographic properties required by the electronic industry. This can be achieved by careful control and maintenance of all parameters essential in electrodeposition. Preferably, grain-refining organic additives are used in the main electrolyte to obtain the desired foil properties.

The raw foil is pale pink in color and has two distinctly different looking sides called the shiny side and the matte side. The shiny side, which was plated onto the drum surface and then stripped, is quite smooth. The matte side, which was facing toward the electrolyte and the anodes during fabrication, has a velvety finish. It can be imagined as a set of close-packed cones having typical heights from 5 to 10 microns. The cone heights depend upon the independent variables of foil thickness, current density, solution composition, etc. These peaks provide the basic shape for embedding in the laminate resin to promote adhesion when bonded to a polymeric substrate. Although the matte side of the foil has a certain microroughness, it does not ensure a good enough bonding strength (adhesion) such as is required in fabricating copper-clad laminates. Hence, the need (but not the only one) for a secondary operation which is a surface treatment to enhance bonding.

Thus, in the fabrication of base (raw) foil, copper is plated onto the top surface of the drum, stripped continuously from the drum surface and coiled. This stripping depends on the fact that the adhesion between copper foil and the smooth drum surface is low, which in turn depends on the chemical nature of the top surface of the drum.

Figure 2:
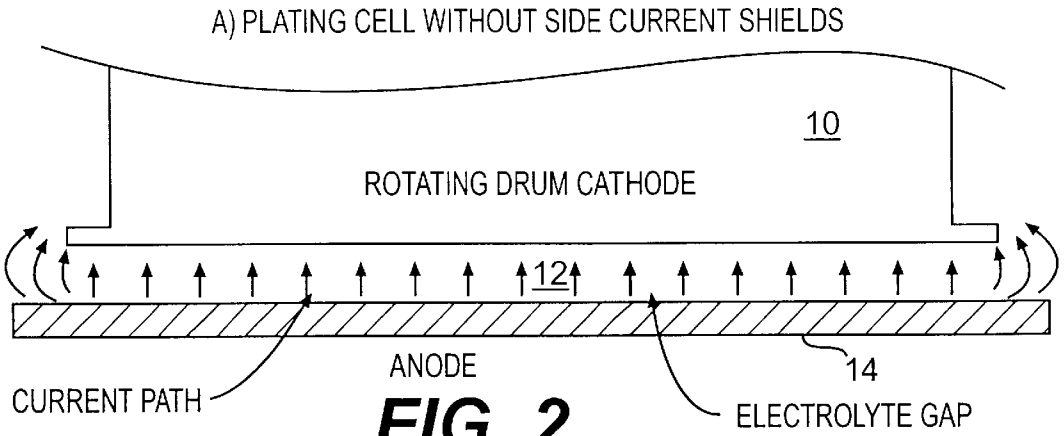
FIG. 2 PRIOR ART
FIG. 2 illustrates a partial top view of a conventional rotating drum cathode and anode.

FIG. 2 shows how the electric current path (indicated by arrows) from the anodes to the cathode can cause copper to plate on the outer edges of the drum's top sheet. However it is important that copper plates only on the top surface of the drum's top sheet. One has to appreciate that the outer edge of the top sheet is sharp, and even with the most perfect machining, has microscopic nicks, abrasions etc. If copper is permitted to plate onto, or around the edge, the outer edge of the copper deposit sticks to the abrasions since the local adhesion of copper deposit plated into the microscopic crevices is higher than the adhesion of the foil to the titanium surface elsewhere. These minute "welds" are the nuclei points of tearing of the foil all across the drum's width. The thinner the foil the more serious the problem, which literally can ruin continuity of production, lower production yields, and in the case of raw foils thinner than ½ ounce (8 microns), threatens the very feasibility of the process.

Figure 6A:
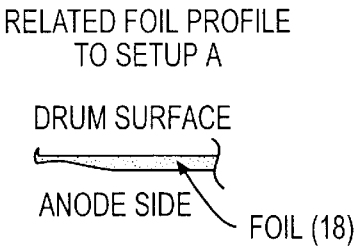
FIGS. 6(A)–6(D) illustrate partial profiles, showing edge portions and central portions, of copper foils produced with the anode arrangements shown in FIGS. 2–5, respectively.

FIG. 6(A) show a typical profile of an outer edge portion of a copper web having a thickness which is less than the nominal thickness of the central portion of the web, due to a different current path through the electrolyte 12 at the outboard edges of the anode 14 and cathode 10, and which also shows how, at the extreme outer edge portion of the web, copper was plated onto the edge of the drum's top sheet.

Figure 3:
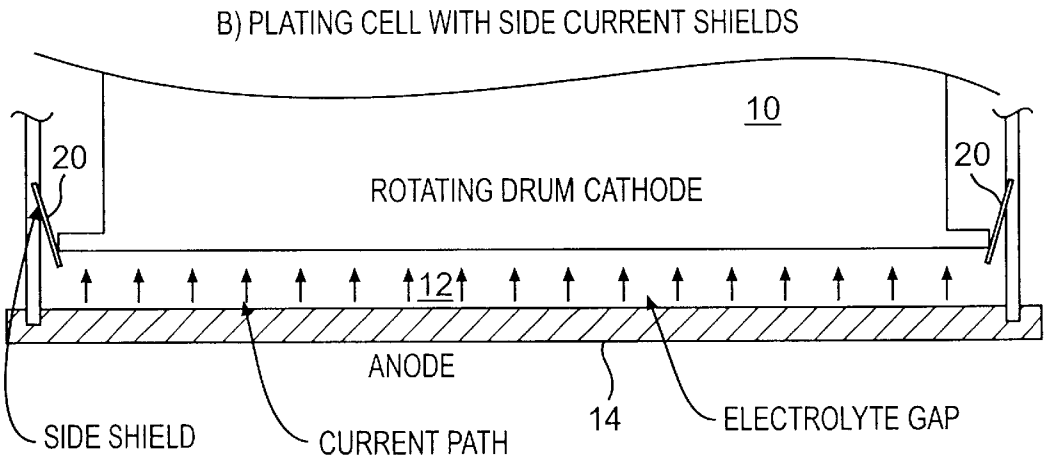
FIG. 3 PRIOR ART
FIG. 3 illustrates a partial top view of a conventional rotating drum and anode with current shields.
Figure 6B:
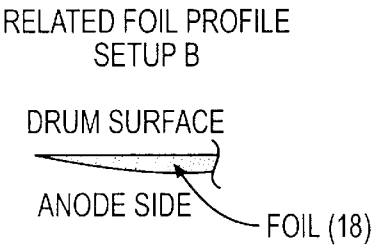

FIG. 3 illustrates a method used to prevent copper from plating onto the edge of the drum's top sheet, wherein dielectric current shields 20 are positioned at each side the anode 14 between the anode and the opposing edge of the drum cathode 10 to prevent the electrolyte, and the electric current, from flowing over the edges of the drum's top sheet. FIG. 6(B) shows a typical profile of one outer edge of foil produced using such current shields.

However, the use of such shielding techniques does not resolve the problem completely, far from it when it comes to the production of 11 or 8 micron thick raw foils. Shields alone have their shortcomings. The electrolyte next to the stationary, dielectric, side shields is relatively immobile due to the liquid-solid adhesion and the viscous drag. These forces operate on limited distances, but they are real enough to cause the extreme 5 mm or so of the left and right sides of the web to be thinner than the rest of the foil (see FIG. 6(B), because poorer mass transport in these regions causes the plating efficiency to be lower at these locations. Moreover, electrodeposits have a great ability to form in minute spaces between the conducting material (top sheet) and the dielectric material (side shields). That in turn causes the extreme edges of the foil to be jagged, in addition to being thinner, thus giving rise to the "tearing problem" that makes production of 11 or especially 8 micron foil to be almost impossible and certainly uneconomical due to the extremely low production yields.

Based upon our above-mentioned findings, we developed the present method that ensures that the extreme edges, for example the ½ inch sides, of the web of the foil, both left and right sides, are thicker, for example, twice as thick, as the gauge of the central portion of the web.

The above effect is accomplished, as shown in FIGS. 4 and 5, by arranging that the current density distribution across the web favors the extreme edges of the foil extending, for example, some ½ inch, toward the center, on both sides of the web.

Referring to FIGS. 2 and 6(A), we have observed that when copper foil is produced on a conventional drum cathode machine using the electric current path shown by the arrows the current flows through the electrolyte substantially uniformly from each of the anodes to the cathode in the central portion of the machine, so that the central portion of the copper web has a substantially uniform thickness. However, at the extreme outer edges the current flow is not uniform, and the outer edge portions of the copper web have a reduced thickness and the copper is deposited on the outer edges of the cylindrical top sheet of the drum, which makes it more difficult to strip the foil from the top sheet.

As shown in FIG. 3, current shields made of a dielectric material and positioned at each end of the machine may be used to reduce the tendency for the copper to plate out on the edges of the top sheet; however, the outer edge portions of the foil still have a reduced thickness, which results in a tendency for the deposited foil to tear when stripped from the top sheet, especially when producing very thin foil.

As a result of our experimental work directed at solving the above-mentioned tearing problem, especially when making ultra-thin copper foil, we have found that such problem can be mitigated, or eliminated, by employing in the anodes 14, at each of the outer edges of the first central anode 14' portion an edge anode portion 14" which provides a current density greater than that used in the central anode portion. By use of this technique a first current density, preferably from about 40 to about 90 amperes per square decimeter ($A/dcm^2$), in the central portion 14' of the anode causes the central portion of the deposited web to have a substantially uniform average thickness, while a second current density, greater than the first current density, is used in each of the outer anode portion 14" to cause each of the outer edge portions of the deposited web to have a thickness greater than the thickness of the central portion of the web. The greater thickness of the outer portions of the web has been found to significantly reduce the tendency for ultra-thin foil, such as 11 micron, or less, foil, to tear when stripped from the drum.

In accordance with this invention, the above higher current density in the outer anode portions 14" preferably is from 1½ to 3 times, most preferably about 2 times, the current density employed in the central anode portion, which is, for example, from about 60 to 240 $A/dcm^2$. Consequently, the thickness of the outer edge portions of the copper web is from about 1½ to 3 times, preferably about 2 times, the thickness of the central portion of the web. If greater or less thicknesses are desired in either of the outer edge portion and/or the central portion of the web, the current density(ies) can be adjusted accordingly.

Figure 6C:
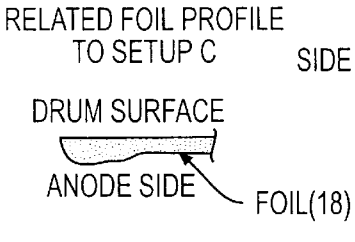
Figure 6D:
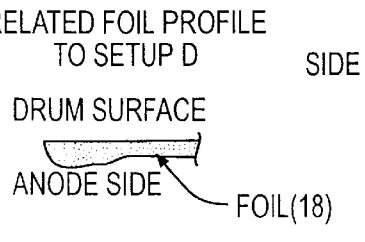

According to a first embodiment of the invention, as shown in FIG. 5, the drum cathode machine is provided with at least one, and preferably a pair of, curved anodes facing and spaced from the drum cathode, and a copper-sulfate/sulfuric acid electrolyte is circulated through the gap between the anodes and the drum cathode. The anodes are made of lead, lead-antimony or other suitable metal which does not dissolve in the electrolyte solution. Each anode 14 comprises a central anode portion 14', herein also referred to as "the first anode" and two anode portions, herein also referred to as "the second anodes." In this embodiment the first and second anodes 14' and 14" are integral and are formed by casting or machining a curved anode so that both of the extreme outboard edge portions thereof extend inwardly toward the drum cathode from the central portion when installed in the machine, so that the second anode-cathode gap is less than, preferably from about ⅓ to ¾, the gap between the first anode and the cathode. Preferably the first anode-cathode gap is about ⅓ to ½ inch, and the second anode-cathode gap is about one-half the first anode-cathode gap. Thus, if electric current is supplied to the anode from a single power source to produce a current density of 40–90 $A/dcm^2$ flowing from the first, central anode through the electrolyte to the cathode, the current density between each of the second anodes and the cathode will be about 80–160 $A/dcm^2$. As shown in FIG. 6(D), this arrangement results in more copper being plated on the cathode in the outer edge portions of the copper web than in the central portion of the web and eliminates the thinned edge portions. Since the outer edge portions are thicker and thus stronger, the tendency for the foil to tear when being stripped from the drum is reduced when compared to foil produced on a conventional machine.

According to a second embodiment of the invention, as shown in FIG. 4, the second, edge anodes 14" are formed separately of a suitable metal, and each is attached to the inside (the side facing the cathode) of the first anode, but electrically insulated from the first anode by a dielectric material 22. Electric current is supplied to the second anodes from a second power source to produce a current density in the second anode-cathode gap which is greater than the current density in the gap between the first, central anode and the cathode. Similar to the above first embodiment, this results in the outer edge portions of the copper web being thicker than the central portion of the web, as shown in FIG. 6(C). Alternatively, the second edges anodes may be attached to the outer ends of the first, central anode.

The main anode is usually made of lead (or lead with some 5% addition of antimony to make it harder), and because lead is a relatively soft metal it gets eroded by the fast flowing electrolyte; consequently the anode-drum "gap" gets gradually wider than the starting ⅓" or so (8 mm) to a double of that distance some 6 months later.

An anode material which is not subject to erosion is titanium plate whose side that faces the electrolyte is coated with platinum or more popularly with irridium oxide ($IrO_2$). That type of anode material is preferably used as a strip on the left and right sides of the main anode, to employ higher (double) current density to double the thickness of the foil on the extreme ½" or so edges of the foil.

This auxiliary anode may preferably be insulated electrically from the main anode, and is operated by a D.C. rectifier separate from the "main" rectifier; in that manner the thickness of the edges can be controlled in a precise manner.

Figure 7:
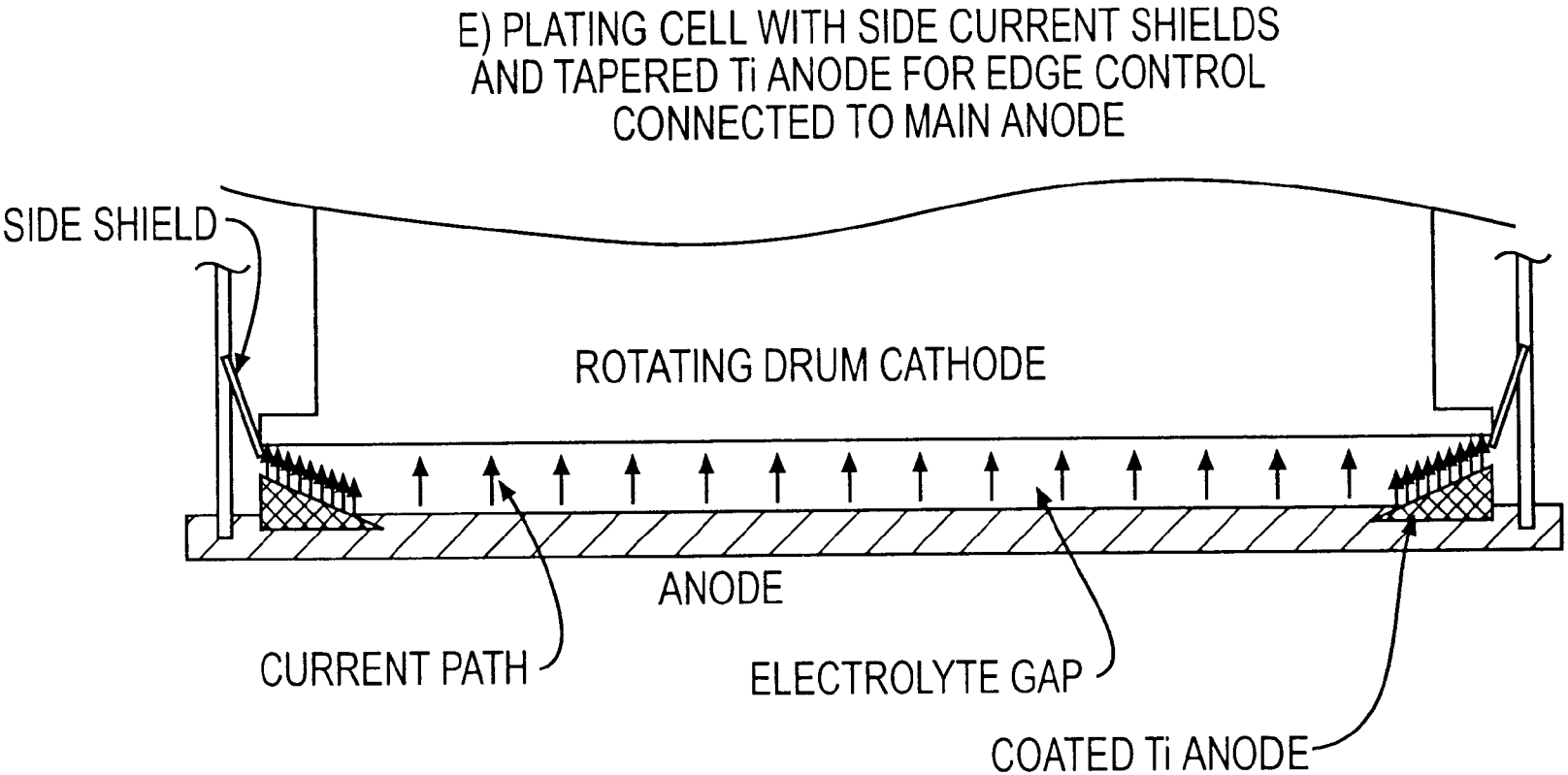
FIG. 7 illustrates another version of the anode arrangement shown in FIG. 5.

Alternately, the auxiliary anode may be connected electrically to the main anode and the desideratum of thicker edges is achieved by "diagnosed" positioning of the auxiliary anode that provides for the current density distribution that favors, the edges, as in FIG. 7.

After the web of raw foil has been stripped from the drum, it is generally desirable to trim the thicker outer edge portions from the central portion of the web to produce a copper foil having a uniform thickness across its width. Therefore, it typically is desired that the thicker, outer edge portions have a thickness and a width sufficient to mitigate the tearing problem, but not greater. Preferably, the width of the edge portions is from about 5 to about 20 millimeters, and most preferably about 10 to 15 millimeters.

The following Table I shows typical plating conditions which may be used in producing 1 ounce copper foil in accordance with the present invention, wherein each of the outer ½ inch edge portions of the web have a thickness approximately 2 times the thickness of the central web portion.

TABLE I

| Drum Current Amps | Current Density Amperes/ $dcm^2$ | Current Density at extreme 1/2' edges of foil | Central Anode Drum Gap | Edge Anode Drum Gap at extreme 1/2" Edges of Foil | Plating Time (1 oz – 1.32 mils) |
|---|---|---|---|---|---|
| 25,0000 | 50–60 | 100–120 | 10 cm | 5 cm | 120 Sec. |
| 40,000 | 80–90 | 160–180 | 10 cm | 5 cm | 75 Sec. |

The following example demonstrates the effectiveness of the present invention in reducing tearing of ultra-thin copper foil produced on a rotating drum cathode.

Two anodes were prepared by milling the drum-side of the central portion of standard curved lead anodes to a depth of 5 cm, leaving each of the ½ inch outer edge portions of each extending inwardly 5 cm from the milling surface. The anodes were then fitted in a rotating drum cathode machine facing the drum cathode to provide a 5 cm gap between the drum's surface and each of the ½ inch outer edge portions of the anodes, and a 10 cm gap between the central portion of each anode and the drum's surface. Current shields were provided between the anodes and the cathode, as described above.

One-quarter ounce raw copper foil was produced on the above machine using the most preferred copper sulfate-sulfuric acid—addition agent electrolyte in Yates et al., U.S. Pat. No. 5,863,410, which is incorporated by reference herein in its entirety. DC electric current was supplied to each of the anodes by a rectifier. The current density in central anode-cathode gap was 85 A/dcm$^2$, and the current density in each of the edge anode-cathode gaps was 170 A/dcm$^2$. The foil was produced using a plating time of approximately 18 seconds. The central portion of the resulting copper web had a nominal thickness of 8 microns, and each of the ½ inch outer edge portions of the web had a nominal thickness of 16 microns. While producing the copper foil, the web was easily stripped from the drum without tearing.

One-quarter ounce copper foil was produced as described above, except that standard anodes were used, and the anode-cathode gap was 10 cm across its width. The current density in the gap was 85 A/dcm$^2$, and the nominal thickness across the width of the web was 8 microns, except that the very edges were about 5 microns thick and very jagged. When stripped from the drum the foil frequently tore across the web.

Having described preferred embodiments of the invention, it is to be understood that alterations and modifications thereof falling within the spirit of the invention may become apparent to those skilled in the art, and the scope of the invention is to be determined by the appended claims and their equivalents.

What is claimed is:

1. An elongated web of electrodeposited copper foil produced on a rotating cathode drum machine, comprising: a central web portion extending along the length of the web; and two edge portions extending along the length of the web, one on either side of the central portion, wherein the central portion has an average thickness and the edge portions each have an average thickness greater than the average thickness of the central portion.

2. The copper foil of claim 1, wherein the average thickness of the portion is from about 1½ to 3 times the average thickness of the central portion.

3. The copper foil of claim 1, wherein the central portion has an average thickness of from about 5 to 20 microns.

4. The copper foil of claim 1, wherein the central portion has an average thickness of about 12 microns or less.

5. The copper foil of claim 1, wherein the edge portions each have a width of from about 3 millimeters to about 20 millimeters.

6. In a process for producing electrolytic copper foil wherein an electric current is passed from an anode through a copper-containing electrolyte to a rotating drum cathode spaced from the anode to electrodeposit copper foil on the cathode, the improvement which comprises: passing an electric current from a first central anode portion to an opposed central portion of the cathode, each of the central portions having a width less than the total width of the cathode, at a first current density; and simultaneously passing an electric current from each of two edge anode portions positioned outwardly of and adjacent the central anode portion at a second current density which is greater than the first current density.

7. The process of claim 6, wherein the first current density is from about 40 to about 9 A/dm$^2$ and the second current density is from about 60 to 240 A/dm$^2$.

8. The process of claim 6, wherein the second current density is from about 1½ to 3 times the first current density.

9. A rotating drum cathode machine for producing electrolytic copper foil comprising:

(a) a rotating drum cathode having a width extending in a direction parallel to an axis about which the drum rotates;

(b) at least one first central anode facing and spaced from the cathode, and having a width extending in a direction parallel to said axis and being less than the width of the cathode;

(c) two second edge anodes each facing and spaced from the cathode, the second anodes each being positioned adjacent an outboard end of the first anode;

(d) the first anode being capable of passing an electric current from the first anode to the cathode, during use of the machine, at a first current density; and (e) the second anodes each being capable of passing an electric current from the anode to the cathode, during use of the machine, at a second current density which is greater than the first current density.

10. The machine of claim 9, wherein the second anodes are each spaced from the cathode at a distance less than that of the spacing between the first anode and the cathode.

11. The machine of claim 10, wherein the second anodes are made of the same material as and integral with the first anode.

12. The machine of claim 11, wherein the first and second anodes are adapted for connection to a single source of supply of electric current.

13. The machine of claim 9, wherein the second anodes are separate from and electrically insulated from the first anode.

14. The machine of claim 13, wherein the first anode is adapted for connection to a first source of supply for electric current, and the second anodes are adapted for connection to a second source of supply of electric current.

15. The machine of claim 9, further including a current shield positioned between each of the outer edges of the second anodes and the cathode.

16. Copper foil produced by trimming the edge portions from the copper foil of claim 1.

* * * * *

UNITED STATES PATENT AND TRADEMARK OFFICE

CERTIFICATE OF CORRECTION

PATENT NO. : 6,291,080 B1
DATED : September 18, 2001
INVENTOR(S) : Yates et al.

It is certified that error appears in the above-identified patent and that said Letters Patent is hereby corrected as shown below:

Title page,
Item [73], Assignee, "Foll" should read -- Foil --.

Column 7,
Line 52, "thickness of the portion" should read -- thickness of the edge portion --.

Column 8,
Line 14, "40 to about 9/dm$^2$" should read -- 40 to 90 A/dm$^2$ --.

Signed and Sealed this

Fourteenth Day of May, 2002

*Attest:*

*Attesting Officer*

JAMES E. ROGAN
*Director of the United States Patent and Trademark Office*